United States Patent [19]

Tell

[11] Patent Number: 4,960,364

[45] Date of Patent: Oct. 2, 1990

[54] VACUUM EJECTOR DEVICE

[76] Inventor: Peter Tell, Breviksvägen 27, S-184 22 Åkersberga, Sweden

[21] Appl. No.: 363,065

[22] Filed: Jun. 6, 1989

[30] Foreign Application Priority Data

Jun. 8, 1988 [SE] Sweden ..... 8802143

[51] Int. Cl.[5] ..... F04F 5/00

[52] U.S. Cl. ..... 417/174; 417/151

[58] Field of Search ..... 417/174, 151

[56] References Cited

U.S. PATENT DOCUMENTS 3,352,348 11/1967 Davian ..... 417/174

4,395,202 7/1983 Tell ..... 417/169

FOREIGN PATENT DOCUMENTS 61-4899 1/1986 Japan ..... 417/151

61-4900 1/1986 Japan ..... 417/174

*Primary Examiner*—Leonard E. Smith

*Assistant Examiner*—Robert N. Blackmon

*Attorney, Agent, or Firm*—Witherspoon & Hargest

[57] ABSTRACT

The present invention relates summarily to a mult-ejector device with at least one ejector part (2) including at least one array of ejector jets (18, 19, 20) placed one after the other in the ejector part (2). Under the action of compressed air flowing through them, the jets (18, 19, 20) generate a subpressure in chambers (11, 12) connected to the jets. The chambers (11, 12) are in communication via openings (13, 15, 17) provided with non-return valves (14, 16) with a vacuum collection chamber (9), to which the tool or the like driven by the ejector device is connected. The ejector part (2) is an element in the shape of a plate formed by moulding or in some other way, where the ejector jets (18, 19, 20) and the valve chambers (11, 12) are formed integrally in the plate-like piece. The ejector part (2) is suitably parallelepipedic in shape, with pairs of arrays of jets (18, 19, 20) extending lengthwise through it, with each array ajacent the long side of said part and the vacuum collection chamber (9) placed between two jets (19).

7 Claims, 4 Drawing Sheets

VACUUM EJECTOR DEVICE

The present invention relates to vacuum ejector devices and more particularly to so-called multi-ejector devices, in which several ejector jets are placed one after the other, and in certain embodiments side by side as well.

An ejector device is already known, e.g. from the Swedish patent No. 8003819-3, this device being similar to the one according to the present invention and is intended for use in substantially the same applications, e.g. picking or plucking equipment and the like. The general problems in connection with such use of ejector devices are dealt with in this patent and these problems are also generally known.

With respect to their implementation and effectivity, it is thus desirable to have the ejector devices, which are driven by excess pressure, i.e. compressed air, as close as possible to the work place for the subpressure generated by the ejector device. The ejector devices in the prior art have a perfectly satisfactory function, but they are comparatively heavy, since they are entirely or partially produced from metal and they are expensive, since they are put together in many ways and with details machined with great accuracy.

It has long been a desire to obtain an ejector device which has good capacity and which is suitable for manufacturing with a minimum of subsequent assembly work. This device should be compact, as light as possible and cheap.

The present invention has the object of achieving the above mentioned desires. This object is achieved by an ejector device of the kind disclosed in the claims, which also disclose the characterizing features of the invention.

Figure 1:
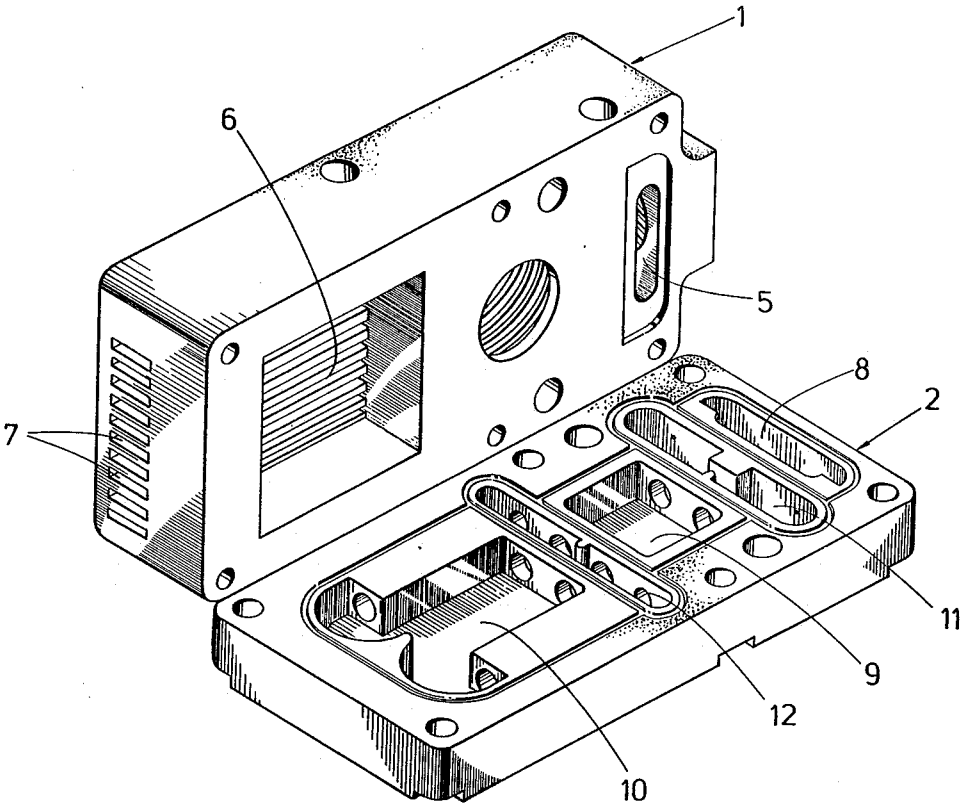
Figure 2:
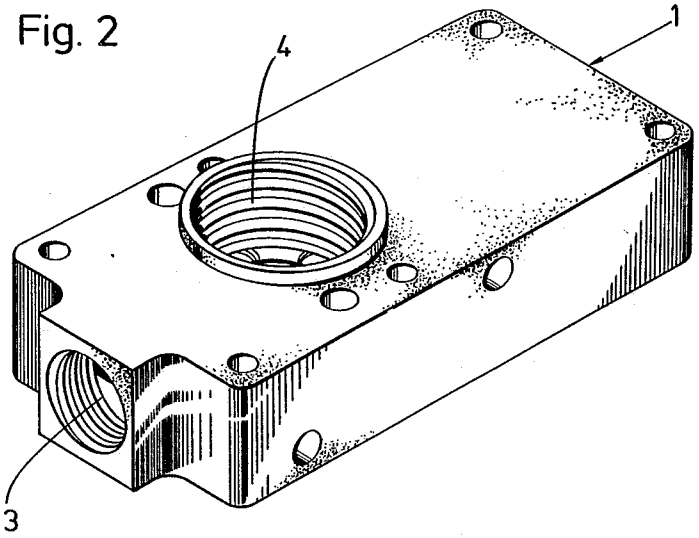
Figure 3:
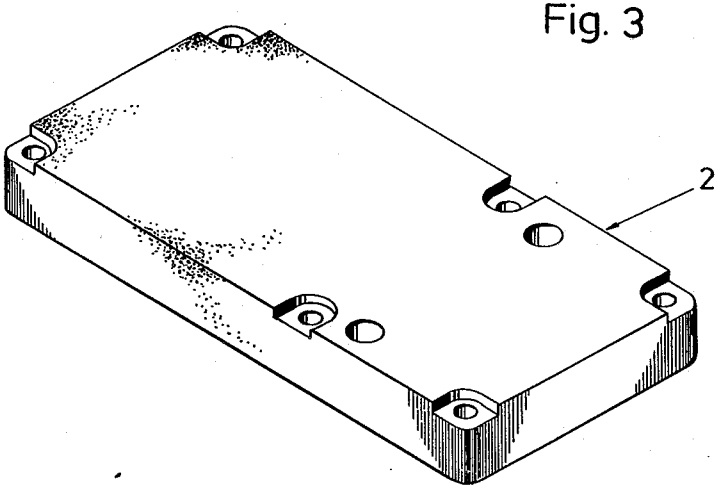
Figure 5:
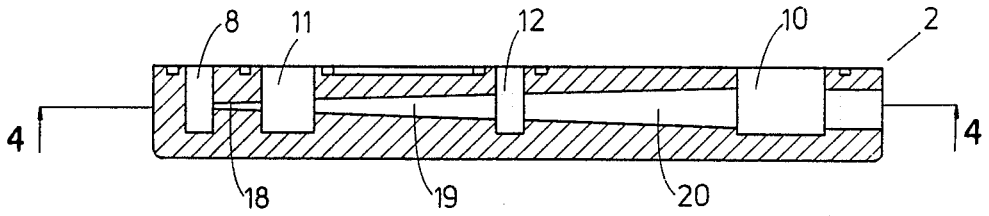
Figure 4:
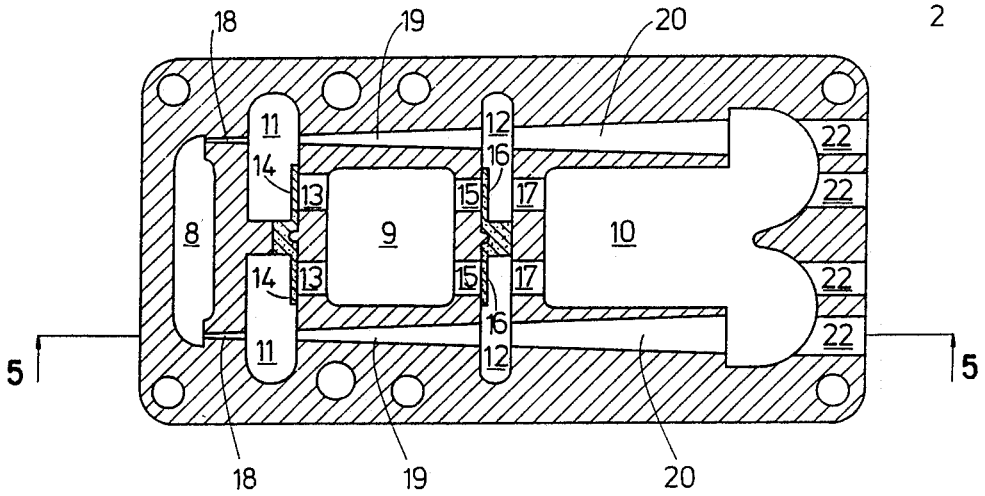

The invention will now be described in more detail and in connection with the accompanying drawings where FIG. 1 is a perspective view of an embodiment of the inventive ejector device, shown in an opened state for illustrating the positions of the details inside the device, FIG. 2 is a perspective view of the lid of the ejector device seen from the outside, FIG. 3 is a perspective view of the part of the ejector device containing the ejector means, seen from the outside, FIG. 4 is a longitudinal section through the part containing the ejector means, this section being taken parallel to the superficial extension of the part along the line B—B in FIG. 5, and FIG. 5 is a longitudinal section taken along the line A—A in FIG. 4.

The embodiment of the ejector device in accordance with this invention, and shown in FIG. 1, comprises a substantially parallelepipedic lid 1, and a similarly substantially parallelepipedic part 2 containing the ejector means. Other shapes are possible, per se, which will be obvious to one skilled in the art. The lid 1 has an input 3 in one short end for the compressed air which is to drive the device, and arranged in its outside phase it has an output 4, to which the vacuum driven equipment is to be connected. Such equipment may comprise a suction body inserted directly into the output 4. In the lid 1 there is further an inlet chamber 5 in communication with the input 3 and an outlet chamber 6 in communication with the output 4. A duct system 7 from the outlet chamber 6 opens out into the ajacent end wall of the lid 1, and the compressed air used in the ejector action of the device is released through this duct system 7, which has a silencing action. Further silencing can be obtained by the outlet chamber 6 being at least partially filled with a silencing material.

The ejector part 2, which is here shown as a bottom part, contains three working chambers: a pressure chamber 8 communicating with the inlet chamber 5, a collection chamber 9 and an output chamber 10. The output chamber 10 communicates with the outlet chamber 6. There is a first valve chamber 11 between the pressure chamber 8 and collection chamber 9, and a second valve chamber 12 between the output chamber 10 and the collection chamber 9. The collection chamber 9 is in communication with the first valve chamber 11 via a pair of orifices 13, which are provided with non-return valves 14, these valves allowing flow from the collection chamber 9 to the first valve chamber 11, but prevent a flow in the opposite direction. A pair of orifices 15 connect the collection chamber 9 to the second valve chamber 12, and a pair of non-return valves 15 allow flow through the orifices 15 from the collection chamber 9 to the second valve chamber 12, but prevent flow in the opposite direction. A pair of orifices 17 allow flow between the output chamber 10 and the second valve chamber 12.

The illustrated embodiment of the ejector device is provided with a pair of ejector jet arrays, but it will be understood that only one array could be used. In the two arrays of ejector jets illustrated, a first pair of jets 18 is arranged between the pressure chamber 8 and the valve chamber 11, a second pair 19 extend between the first valve chamber 11 and the second valve chamber 12 and a third pair 20 extend between the second valve chamber 12 and the output chamber 10. The jets 18, 19, 20 in each array are made in the same piece as the ejector part 12 itself.

A gasket 21 is arranged between the meeting surfaces of the part 2 and the lid 1 so that all chambers are sealed from each other when the part 2 and lid 1 are placed against each other.

Several ejector parts 2 can be placed one on top of the other to increase the capacity of the ejector device. The bottoms in the chambers 8, 9 and 10 are then provided with openings so that corresponding chambers in the different ejector parts are in mutual communication. The ejector device is suitably kept together by unillustrated screws, although other methods of keeping the parts together can be envisaged. The lid may also constitute part of such as a robot arm, the different details of the lid then being formed in the robot arm or the like.

The ejector device in accordance with the present invention is suitably manufactured from an appropriate plastics material by injection moulding or some other type of moulding. It will be understood that the exterior shape of the device does not have any importance. It will be seen from FIGS. 4 and 5 how the ejector part itself is fabricated, a mould being used for determining the general appearance of this part. Cores for the different chambers 8–12 are inserted in the mould and removed from it via the open side of the ejector part 2. The cores for the jets 18, 19, 20 and openings 13, 15 and 17 are inserted and removed via holes 22 in one end wall of the ejector part 2. These holes 22 are subsequently plugged in a suitable way. In operation, compressed air is supplied through the input 3 to the pressure chamber 8. The air then flows through the jets 18 into the valve chamber 11 and from there through the jets 19 to the valve chamber 12, from whence through the jets 19 to the valve chamber 12 and from the valve chamber 12 through the jets 20 to the output chamber 10 via the outlet chamber 6 and duct system 7 into the surroundings. Vacuum is then formed in the valve chambers 11 and 12. The non-return valves 14 and 15 are then opened and the vacuum occurs in the collection chamber 9. When the vacuum in the chamber 12 is equally as great as in the collection chamber 9 the non-return valves 16 close, while the vacuum in the collection chamber continues to increase. When the maximum vacuum of the device has been reached, the non-return valves 14 also close and the vacuum attained maintain until inward leakage or supply of air to the collection chamber 9 or its associated parts takes place.

The function of this ejected device is thus substantially conventional, but its implementation is unique in as far as the ejector jets are an integral part of the ejector part itself. This device is thus not to be confused with other large cast metal ejectors for driving with steam and the like, and it is here a question of a very small ejector device, of the size between 5 and 10 cm long and 2 to 4 cm wide and with a thickness of similarly some few centimeters, the ejector part being approximately 5 mm thick.

By placing several ejector parts one on top of the other, the capacity of the ejector device can be increased if this is essential. This thus signifies that the pressure can be reduced in a larger space relatively quickly but the maximum vacuum is determined by the implementation and arrangement of the jets. Placing the different chambers before or between the jets has contributed substantially to the compact implementation of the device.

It will thus be understood that the ejector device in accordance with this invention is a substantial step forward in this field of art. It will also be understood that many modifications of the ejector device in accordance with the invention are possible but also that these are within the scope of the accompanying claims.

I claim:

1. Multi-ejector device comprising at least one ejector part comprising a substantially rectangular plate, said plate including at least two sets of ejector nozzles each set including a first nozzle, which communicates with a pressure chamber, axially spaced from a second nozzle which is axially spaced from a third nozzle which communicates with an outlet chamber, a first set of said at least two sets of nozzles being located at a first longitudinal side of said plate, and a second set of said at least two sets of nozzles being located at an opposite second longitudinal side of said plate, a first valve chamber extending transversely relative to each longitudinal side and communicating with and located between each first nozzle and each second nozzle, and a second valve chamber extending transversely relative to each longitudinal side and communicating with and located between each second nozzle and each third nozzle, a collection chamber being in communication with said first valve chamber through first openings extending from said first valve chamber to said collection chamber and in communication with said second valve chamber through second openings extending from said second valve chamber to said collection chamber, said collection chamber being positioned between said first and second valve chambers and said second nozzles, said outlet chamber being in communication with said second valve chamber through third openings extending from said second valve chamber to said outlet chamber, a first check valve mounted in each first opening to allow air to flow only in a direction from said collection chamber to said first valve chamber, and a second check valve mounted in each second opening to allow air to flow only in a direction from said collection chamber to said second valve chamber, each nozzle, chamber and opening being shaped directly within and integral with said plate, and means for attachment to said plate for enclosing said at least one ejector part.

2. Multi-ejector device including at least one ejector part (2) to be covered by a lid means and which contains two sets of ejector nozzles (18, 19, 20) each set having a predetermined number of nozzles located one after the other, and a set of valve chambers (11, 12), the ejector nozzle sets (18, 19, 20) being in communication with each valve chambers (11, 12) for evacuating the valve chambers, the valve chambers (11, 12) in turn being in communication with a vacuum collection chamber (9) through openings (13, 15, 17), check valves (14, 16) being mounted in said openings (13, 15, 17) in order to allow air flow only from the vacuum collection chamber (9), to which chamber the tool or the like to be driven by the ejector device is connected, the ejector part (2) being in the shape of a substantially rectangular plate having the nozzles of each set arranged one after the other in such a way that one set of nozzles is located at each longitudinal side of the ejector part (2), the nozzles (18, 19, 20) being shaped directly within and integral with the ejector part (2), the valve chambers (11, 12) extending transversely to the ejector part (2) between the pairs of ejector nozzles (18, 19 and 19, 20 respectively), and the vacuum collection chamber (9) being located between the second pair of nozzles (19) and the chambers (11, 12).

3. Multi-ejector device as claimed in claim 2 wherein said device includes a plurality of ejector parts (2) located one upon the other, the chambers (11, 12) and the vacuum collection chambers (9) of the ejector parts (2) being located between the lid means, the ejector part (2) constituting the bottom of the device and being provided with opening means into a corresponding adjacent chamber in an adjacent ejector part (2).

4. Multi-ejector device as claimed in claim 2 wherein said device is moulded.

5. Multi-ejector device as claimed in claim 3 wherein said device is moulded.

6. Multi-ejector device as claimed in claim 4 wherein said device is injection moulded.

7. Multi-ejector device as claimed in claim 5 wherein said device is injection moulded.

* * * * *